United States Patent [19]

Archibald

[11] 4,401,345

[45] Aug. 30, 1983

[54] HYDRAULIC BOREHOLE MINING SYSTEM

[75] Inventor: William R. Archibald, King County, Wash.

[73] Assignee: Flow Industries, Inc., Kent, Wash.

[21] Appl. No.: 370,607

[22] Filed: Apr. 22, 1982

Related U.S. Application Data

[63] Continuation of Ser. No. 145,573, Apr. 30, 1980, abandoned.

[51] Int. Cl.[3] ..... E21C 45/00

[52] U.S. Cl. ..... 299/64; 175/67; 175/213; 299/17

[58] Field of Search ..... 299/1, 4, 17, 64; 175/67, 213; 239/590, 590.5, 594

[56] References Cited

U.S. PATENT DOCUMENTS

| | | | |
|---|---|---|---|
| Re. 29,021 | 11/1976 | Archibald et al. | 175/67 X |
| 1,851,565 | 3/1932 | Claytor | 299/17 X |
| 1,960,932 | 5/1934 | Tracy | 299/4 |
| 2,893,716 | 7/1959 | Smith | 239/590 X |
| 3,393,013 | 6/1968 | Hammer et al. | 299/17 |
| 3,597,166 | 8/1971 | Hochman | 239/590.5 |
| 3,880,470 | 4/1975 | Davis | 299/17 |
| 4,074,779 | 2/1978 | Cheung et al. | 175/213 X |
| 4,134,619 | 1/1979 | Bunnelle | 299/17 |
| 4,141,507 | 2/1979 | Rump | 239/590.5 |
| 4,167,290 | 9/1979 | Yamazaki et al. | 299/1 |

*Primary Examiner*—Ernest R. Purser

*Attorney, Agent, or Firm*—Don R. Mollick; David L. Deits; Gregory W. Moravan

[57] ABSTRACT

A hydraulic underground mining system for operating through a small diameter borehole into a subterranean body. An elongated mining tool includes a liquid jet nozzle that is movable in a vertical direction along the length of the mining tool for forming a directed jet stream to impact material in the ore body and convert the material into a slurry. An orifice is positioned below the jet so that slurry flows into the orifice, the latter being connected to a jet pump which returns generated slurry to the surface. Suitable hydraulic power means are provided for operating the jet pump and for moving the jet stream in vertical and circular directions. Means for monitoring and controlling the progress of mining and the condition of components of the system are provided to monitor and control the system from a centralized location.

8 Claims, 11 Drawing Figures

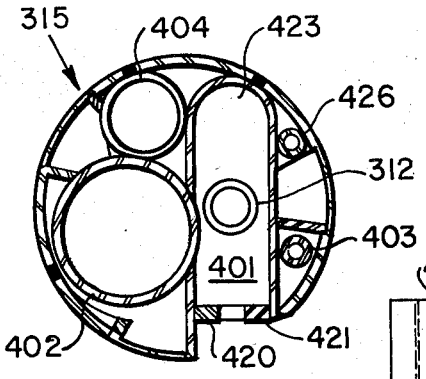
FIG. 7
FIG. 8
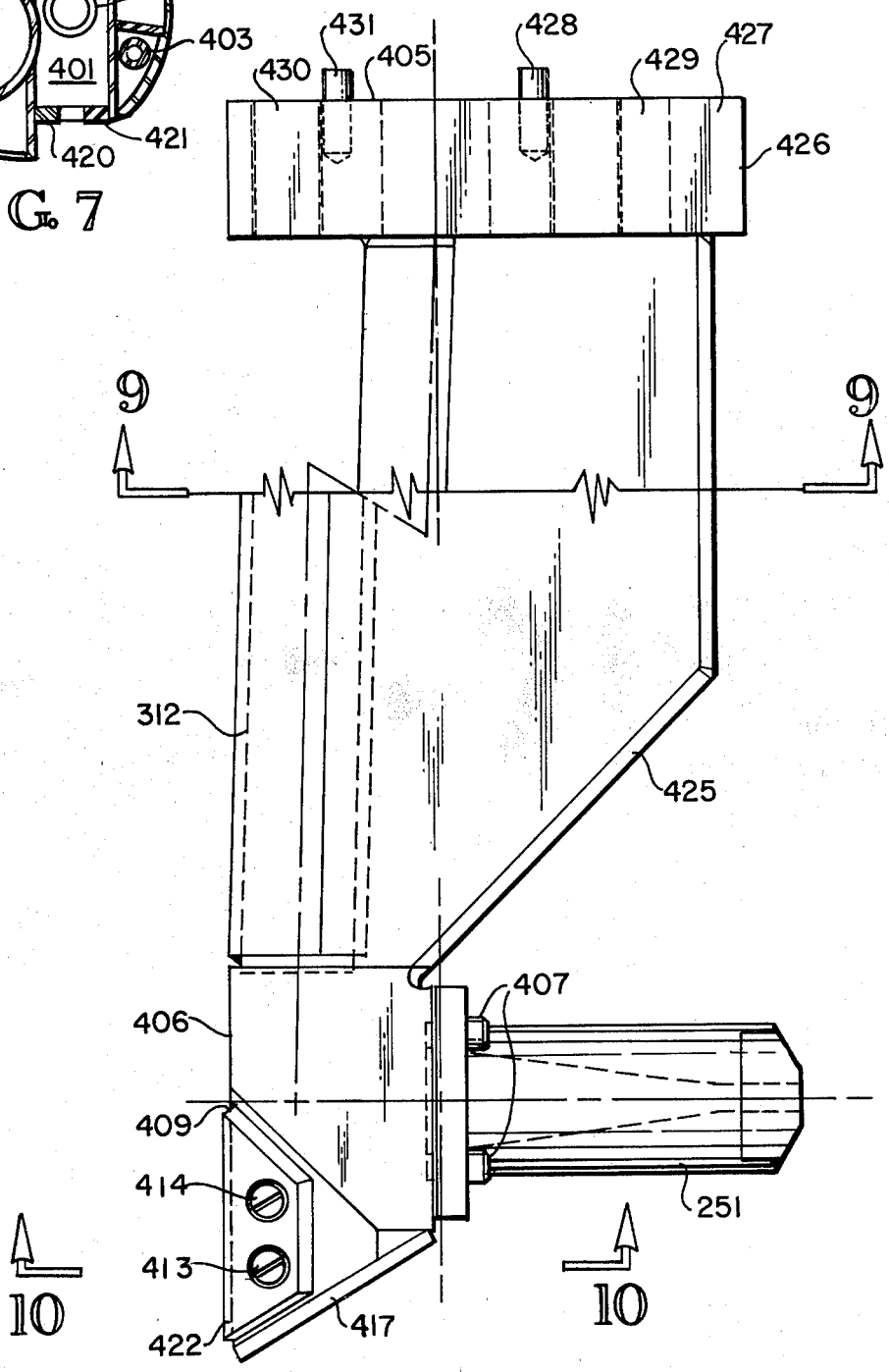

FIG. 9
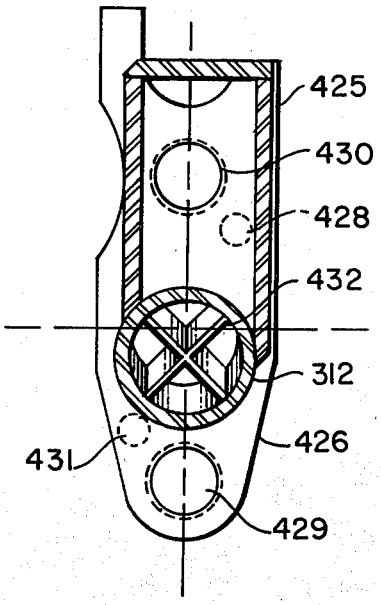
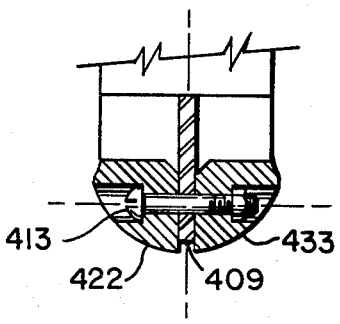
FIG. 10
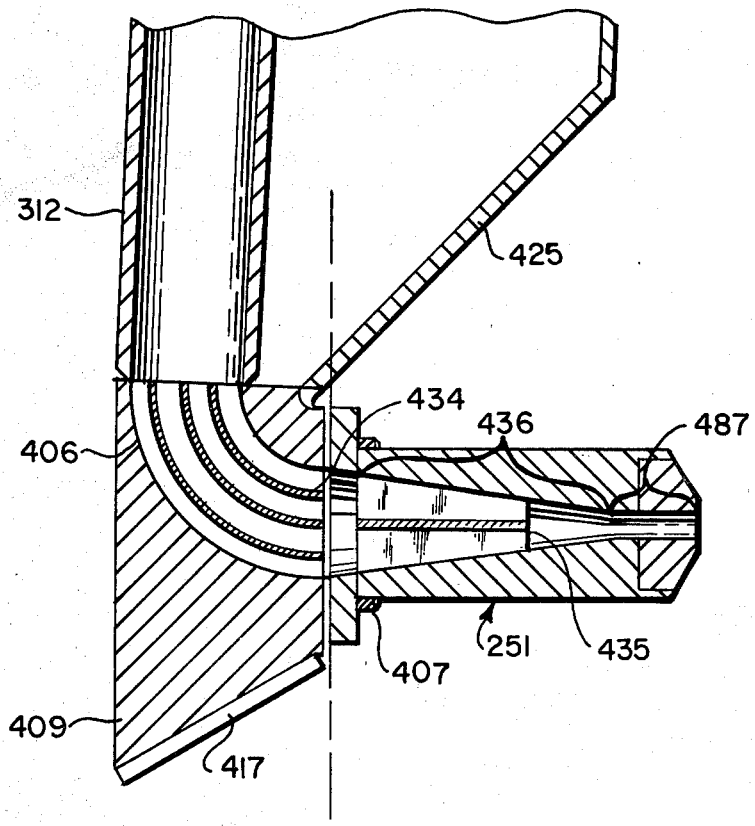
FIG. 11

HYDRAULIC BOREHOLE MINING SYSTEM

This is a continuation of application Ser. No. 145,573 filed Apr. 30, 1980 and now abandoned.

BACKGROUND OF THE INVENTION

1. Field of the Invention

This invention relates to hydraulic underground mining systems. More particularly, this invention relates to hydraulic borehole underground mining accomplished by a high pressure liquid jet nozzle movable in vertical and circular directions to cause formation of a slurry, which is removed to the surface by means of a jet pumping apparatus.

2. Description of the Prior Art

Known methods for borehole mining of unconsolidated ores, such as phosphates or uranium, require predrilling a borehole into the ore formation and lining the borehole with a casing if the overburden is unconsolidated material. A mining tool inserted through the borehole serves to disintegrate the ore by jetting a mining fluid, usually water, into the ore formation. A slurry is thus formed which contains the mining fluid and ore in suspension and which is pumped upward through the mining tool to the ground surface. Prior art methods include jet pumps located in the lower portion of the borehole to receive a supply of high pressure fluid from the surface and also include force pumps located at the lower portion of the borehole with the force pumps receiving either hydraulic or electrical power from the surface.

Hydraulic borehole mining systems have not been widely used due to a number of problems which arise in their implementation. If a mechanical force pump is located in the lower portion of the borehole, the construction and operation of the mining tool is greatly complicated. Mechanical force pumps are prone to break down, requiring frequent servicing, which, if the pump is located in the lower portion of the borehole, requires removal, repair and reinsertion of the mining head with consequent expense and loss of time. If jet pumps are used to lift the slurry from the mining area, large quantities of high pressure water are required for the powering of the pump, resulting in a dilute slurry which is expensive to separate into its component parts. Bore hole mining systems currently in use require removal of the mining tool to position the cutting jet in a vertical direction. U.S. Pat. No. 3,797,590, reissued as U.S. Pat. No. Re. 29,021, illustrates a bore hole mining system which allows partial movement of the cutting jet in a circular path; but the cutting jet is not rotatable for more than a portion of an arc; and the mining tool must be lifted to move the cutting jet in the vertical direction. Easy mobility of the cutting jet is of great economic benefit in the mining of minerals such as uranium where the ore is found in isolated lensatic deposits. Current bore hole mining systems also do not provide means for monitoring the condition of the bore hole or indicating the degree of completion of mining of an isolated formation. The lack of complete monitoring apparatus complicates the control of the operation of the borehole mining system, increasing labor costs and time required to mine the formation. Borehole mining systems currently in use are limited to mining of unconsolidated formations such as phosphate ores. The above-mentioned problems have prevented the wide-scale adoption of borehole mining system in other than the specialized cases noted above.

SUMMARY OF THE INVENTION

Accordingly, the present invention provides a borehole mining system which includes a jet cutting means that reduces the ore surronding the borehole to a slurry, which is pumped to the surface. The invention includes fluid supplies for the cutting jet and pump and permits recycling of the fluids. The cutting jet is rotated and moved in the vertical direction independently of the remainder of the system.

BRIEF DESCRIPTION OF THE DRAWINGS

FIG. 7 is a cross-sectional view of the mining tool of FIG. 3 taken along line 7—7;

FIG. 8 is a side elevational view of the cutting jet assembly;

FIG. 9 is a cross-sectional view of the FIG. 8 cutting jet assembly along line 9—9;

FIG. 10 is a cross-sectional view of the FIG. 8 cutting jet assembly along line 10—10;

and;

FIG. 11 is a cross-sectional view taken along the vertical centerline of the FIG. 8 cutting jet assembly.

DESCRIPTION OF THE PREFERRED EMBODIMENT

Figure 1:
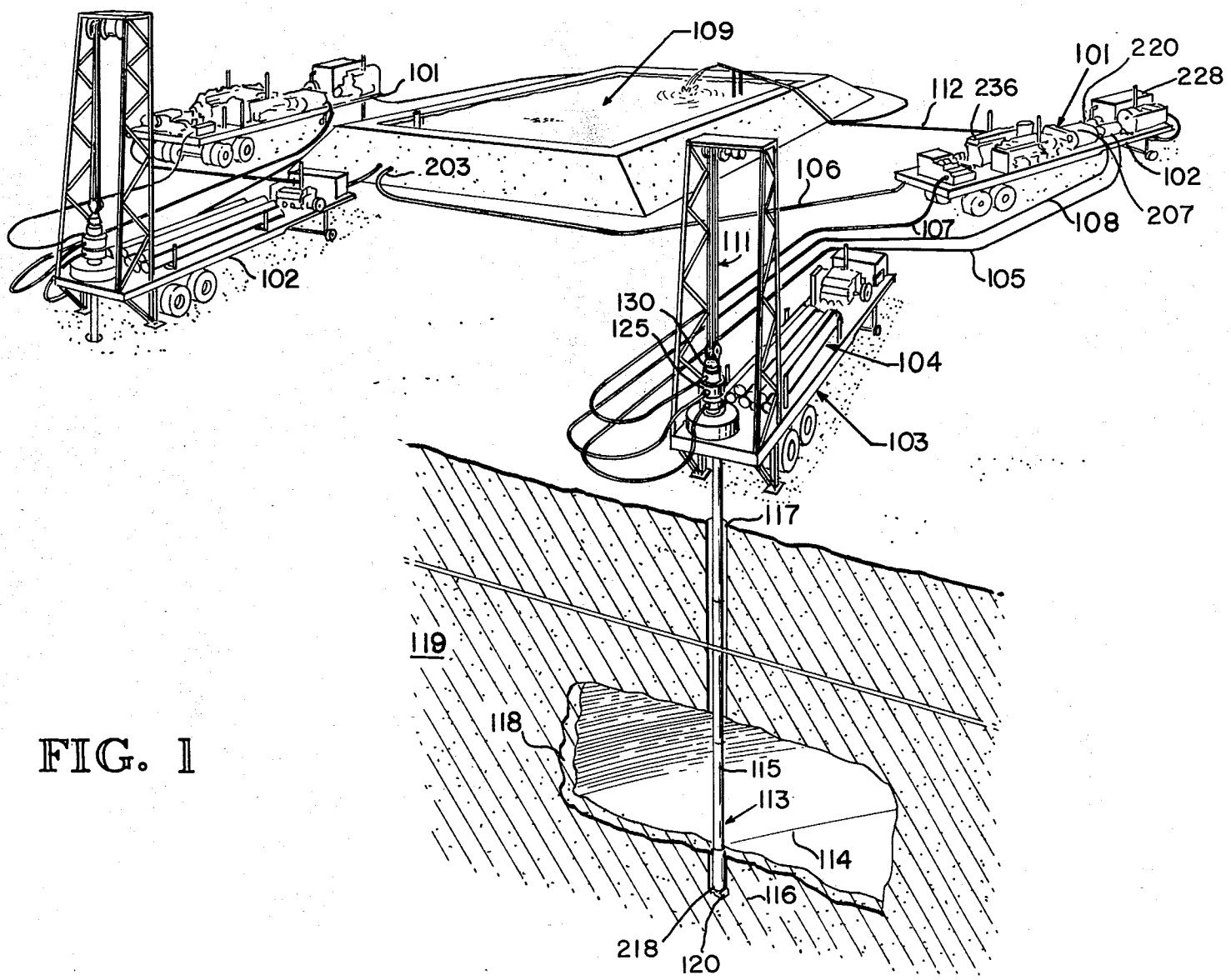
FIG. 1 illustrates the borehole mining system of the invention in a working environment.

FIG. 1 illustrates an apparatus in a working environment that accomplishes the method of the invention. Two mining systems with associated boreholes are illustrated in FIG. 1, and one of the mining systems will be described in detail. First, the mining system is transported to the site of an ore deposit 119 by a pump trailer 101 and a mining trailer 103. Use of the trailers 101 and 103 allows mobility of the mining system when scattered deposits of minerals are being mined. The mining trailer 103 provides both storage space for mining tool sections 104 and apparatus for the lowering and operating a mining tool 113 in a borehole 117. The mining tool 113 is connected to apparatus on the pump trailer 101 by a plurality of lines 105, 107 and 108 which allow passage of fluids between the mining tool 113 and the pump trailer 101.

Figure 2:
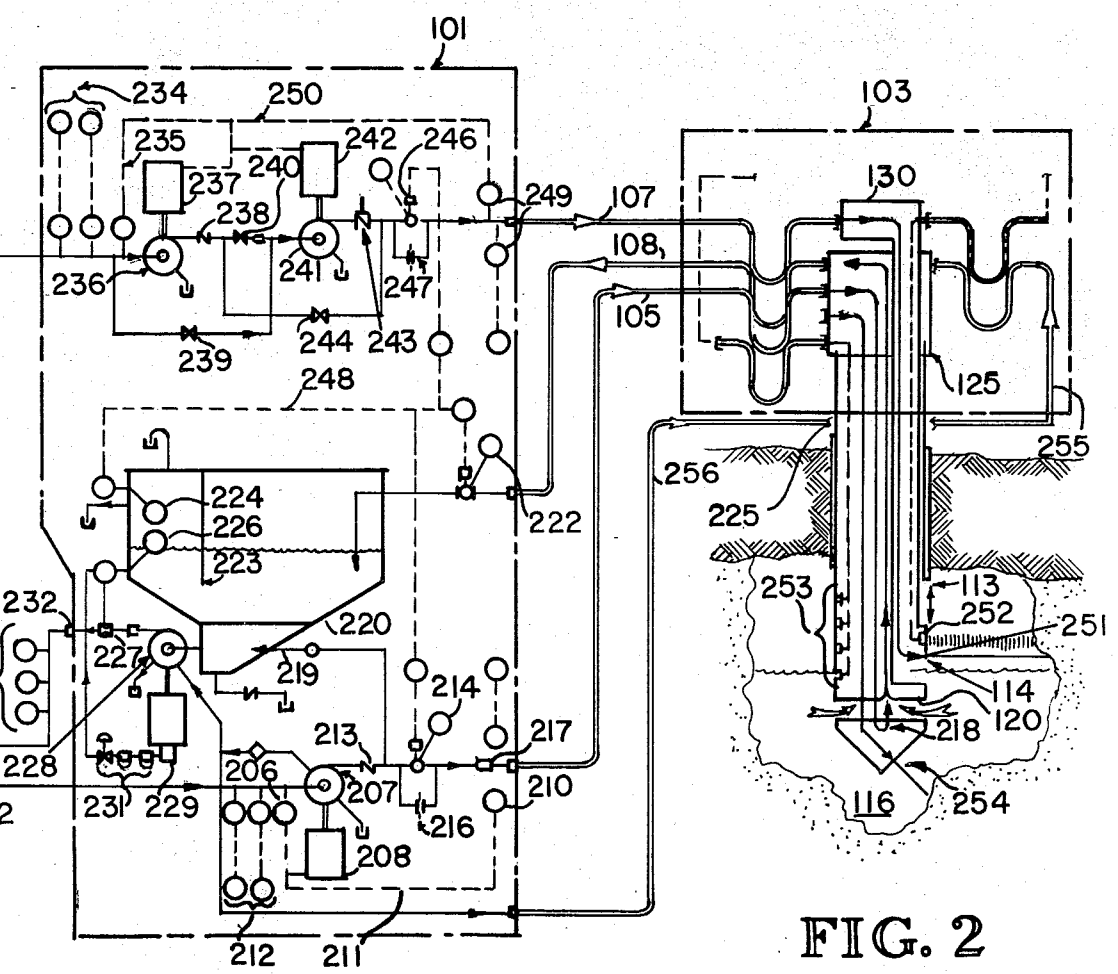
FIG. 2 is a fluid circuit diagram of the control system of the invention.

Referring to FIGS. 1 and 2, the line 107 connects a high pressure pump 237 on the trailer 101 to the mining tool 113 and is the source of the high pressure water used to form a cutting jet 114. The line 108 is the path taken by slurry from the borehole 117 to a slurry pump 220 on the pump trailer 101, which is used to pump the slurry. The line 105 conducts water from a jet pump supply pump 207 on the trailer 101 to the mining tool 113 for use in pumping slurry to the surface. An additional line 112 runs from the pump trailer 101 to a settling pond 109 to serve as the path for the slurry pumped from the borehole 117 to the settling pond 109. The line 106 from the slurry pond 109 to trailer 101 is the path used to recycle water in the operation. An additional water source (not shown), such as a well or stream, is needed for priming the operation and compensating for losses.

The first portion of the apparatus described is the apparatus associated with the borehole 117 and the trailer 103. The borehole 117 is drilled to a depth of approximately 20 feet below the ore body 118. The borehole 117 is left uncased if it is drilled through consolidated overburden material 119. If the overburden material 119 is unconsolidated, the borehole 117 may be cased. The mining trailer 113 is positioned so that a hoist 111 is located directly over the borehole 117, and the hoist 111 is then used to lower the mining tool 113 into the borehole 117. The length of the mining tool 113 is varied by choice of the number of sections 104 which may be added and lowered by the hoist 111, and the length of the mining tool 113 is chosen so that the bottom portion of the mining tool 113 is near the bottom 116 of the borehole 117. Finally, a power swivel 125 is attached to the uppermost section of the mining tool 113 and the hoses 105, 107 and 108 are attached to the power swivel 125. This completes the insertion of tool 114 into the bore 117. The cutting jet nozzle (not shown) from which the jet cutting stream 114 issues is then lowered through the sections of the mining tool 113 until the jet is equal in depth to the lowermost portion of the ore body 118. A separate hoist (not shown) lowers the apparatus (not shown) from which issued cutting jet 114. A separate cutting jet swivel 130 is attached to the uppermost portion of this apparatus and hose 107 attached to this swivel.

Still referring to FIGS. 1 and 2, the second portion of the system is associated with the trailer 101, which is located at a convenient position. In FIG. 1, the pump trailer 101 is located approximately 50 feet from the borehole 117; and the lines 105, 107 and 108 are connected to the pump trailer 101. Line 106 is connected between the water supply of pond 109 and the pump trailer 101. The pump trailer 101 includes two high pressure cutting jet pumps 236 and 241 connected together with the high pressure water from the pumps 236 and 241 being directed through the line 107 into the cutting jet swivel 130 and down the apparatus in the interior of mining tool 113 to the nozzle (not shown) from which the jet 114 issues. The jet 114 erodes the ore of the formation 118, generating the ore slurry, which flows into a jet pump intake 120 located at the lower portion of the mining tool 113. The cutting jet 114 is movable in the vertical direction independent of motion of the mining tool 113 due to its separate hoist. The mining tool 113 and the jet 114 may either be rotated or oscillated by the power swivel 125 in a full circle. This combined motion allows selective separation of the ore of formation 118 from the overburden 119 and removal to the surface of the ore.

FIG. 2 is a fluid circuit diagram of the control system of the invention showing the flow of fluids in the system. Fresh water enters the settling pond 109 through a line 201 to compensate for evaporative losses and leakage in the system. Water to supply the system is withdrawn from the settling pond 109 by pump 203 powered by a plurality of motors 204. The water is filtered initially at an inlet 202 to remove debris that may damage the pumps 203 and further filtered by a pair of filters 205 to further remove suspended material. The filtered water then travels through the line 106 to the pump trailer 101 wherein lies the control circuitry and pumps.

In describing FIG. 2 it is convenient to first describe the flow of water associated with the jet pump supply and slurry removal systems. The feed water enters through the line 106 and is conveyed to a jet supply pump 207 which is powered by a motor 208 which is in turn controlled by a control system 211. The pressure and amount of flow of input water through the line 106 are monitored by a pair of sensors 212 which provide a read out on the control panel of the system. A sensor 206 connected to the inlet line 106 detects low inlet pressure, which could lead to damage of the pump 207. When low inlet pressure is detected by the sensor 206, the control system 211 shuts down the motor 208 connected to the pump 207, thus preventing damage to the pump 207. When the pump 207 operates, its output flows through a check valve 213 and a motor valve 214. A cooling water bypass is provided around motor valve 214 which is connected to surge control system 248. The output of the pump 207 must pass through a reducer 217 and a pass sensor 210 before entering the line 105. The sensor 210 detects excessively high pressure in line 105 which could ultimately damage the system, therefore, when such high pressure is detected, the sensor 210 causes the control system 211 to disconnect power from the motor 208 powering the pump 207. When the system is in operation, high pressure water passes through the line 105 into the power swivel 125 from which it traverses the length of the mining tool 113 to a jet pump 218 (shown in schematic form). The jet pump 218 causes slurry present in the lower portion of the borehole 117 to be drawn through an inlet 120 and into tubes in the interior of mining tool 113; and the slurry rises in the mining tool 113 up into the power swivel 125 from which it is eventually withdrawn through the line 108. The line 108 transfers the slurry from the power swivel 125 to the pump trailer 101 where the slurry passes a motor valve 222 which is connected to a surge control circuit 248. The slurry then enters a slurry tank 220 where gases are allowed to leave the slurry and surges in the flow of material are insulated from the remainder of the system. The level of slurry in the slurry tank 220 is monitored by a pair of level sensors 224 and 226 connected to the control circuits 248 and a control circuit 231, respectively, with the sensors 224 and 226 being protected from surges by a baffle 223 in the slurry tank 220. The slurry in the slurry tank 220 is kept in a state of suspension by jet 219 which receives an input of fluid from the jet supply pump 207. The slurry is removed from the slurry tank 220 by a slurry pump 228, which is driven by a motor 229, which is shut off if the level of slurry in tank 220 falls below a predetermined level as assessed by sensor 226. If the level of slurry in the slurry tank 220 exceeds a predetermined maximum level, the control circuit 248 reduces the flow of water through the line 105 to the jet pump 218. The removed slurry then passes a motor valve 227, which is linked to the sensor 226 and the control circuit 231, thus, allowing fine control of the slurry level in the slurry tank 220. The slurry leaves the trailer 101 by passing into a reducer 232 while the sensors 223 monitor the flow of slurry, its pressure and the ore grade, all of which are displayed on the control panel in pump trailer 101. Finally, the slurry passes through the line 112 to the settling pond 109, from which the water is recycled.

Still referring to FIG. 2, there is shown the supply circuit for the cutting jet 114. Water from the line 106 enters the pump trailer 101, passing pressure and flow indicator sensors 234 which are connected to displays on the control panel (not shown). The water also passes a low pressure indicator 235, which is connected to a pressure shutdown circuit 250 before entering a high pressure cutting jet pump 236. A motor 237 drives the high pressure cutting jet pump 236 to boost the pressure of the feed water. The low pressure indicator 235 sends a signal to the pressure shut-down circuit 250 if the input pressure to the high pressure cutting jet pump 236 is below a predetermined value to prevent damage to the high pressure cutting jet pump 236.

The fluid output of the high pressure cutting jet pump 236 passes through a check valve 238 to a pair of pumping mode valves 240 and 244. If the pumping mode valve 240 is closed while the pumping mode valve 244 is open, the output of the high pressure cutting jet pump 236 passes through the pumping mode valve 244 to a motor valve 245, which is controlled by a control circuit 247. If the pumping mode valve 244 is closed while the pumping mode valve 240 is open, the fluid output of the high pressure cutting jet pump 236 enters a second high pressure cutting jet pump 241, which is driven by a motor 242 to further increase the pressure of the working fluid. The output of the high pressure cutting jet pump 241 passes through a check valve 243 and then passes the motor valve 246. A pair of sensors 249 detects excessively high pressure in the outputs of the high pressure cutting jet pumps 236 and 241 and sends cut-off signals to the motors 237 and 242 if the detected pressure is beyond design limits.

Figure 3:
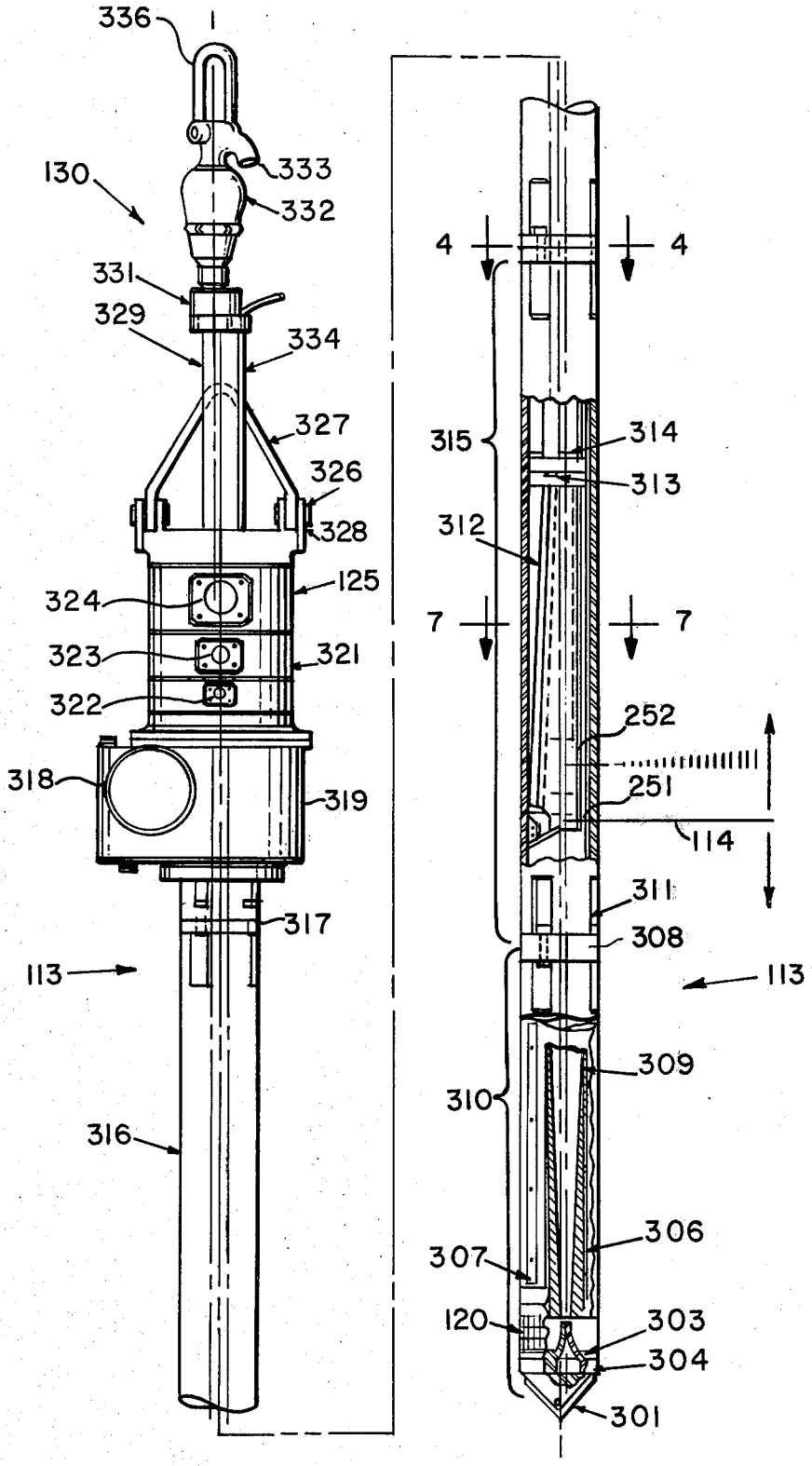
FIG. 3 is a partially sectioned elevational view of the mining tool.

Referring to FIGS. 1, 2 and 3, the output of the pump 236 is conveyed into line 107, which enters cutting jet swivel 130 on mining tool 113; and the high pressure water traverses the length of the mining tool 113 to a nozzle 251 from which issues the cutting jet 114. The cutting jet swivel 130 is movable independently from the movement of the power swivel 125, thus, allowing up and down motion of the jet nozzle 251 and the cutting jet 114 relative to the motion of the mining tool 113. The cutting jet housing is optionally provided with an untrasonic sensor 252 which allows determination of the size of the cavity formed by the cutting jet 114 and the degree of completion of mining. The mining tool 113 has a plurality of level sensors 253, which allow determination of the depth of the water in the bottom 116 of the borehole 117. An agitation jet 254 is optionally provided to keep the slurry in this area of the bore hole in an agitated state. The source of the fluid supply for the agitation jet 254 is similar to that of the jet pump 218. The power swivel 125 provides a swivel seal water connection 225, which returns any leakage from the power swivel 125 through a line 256 to the pump 228. In summation, the mining tool is capable of controlling and monitoring cavity water level, cavity size, cavity profile, slurry grade, flow rate and slurry content, which allows the cutting stream 114 to be controlled by a predetermined mining plan for controlling the vertical movement and the rotation for oscillation of cutting jet 114.

FIG. 3 is a partially sectioned elevational view of the mining tool 113. The mining tool 113 is substantially an elongated cylinder. A bit 301 is mounted to the mining tool 113 and may either be a rotary cone or spade type bit; in the embodiment shown, the bit is a spade type drill. The purpose of the bit 301 is the clearing of materials which may obstruct the bottom of the borehole rather than being a separate drilling apparatus. Immediately above the bit 301 is located the jet pump inlet 120, which is provided with a screen 304 to prevent entry of materials which could jam the operation of the jet pump 218. The jet pump 218 is comprised of a jet 303 and a nozzle section 306. When the mining tool is in operation, high pressure fluid flows down a supply tube 307 to the jet 303, which directs a stream of high pressure fluid upward through the nozzle 306. Slurry which is located outside of inlet 120 is drawn into the nozzle 306 by the venturi action of the combination of the jet 303 and the nozzle 306. An O-ring 304 is provided to seal the jet 303 to the structure of the cutting tool 113. Tubes in the interior of the mining tool 113 supply water to the jet tube 307 and provide a path for the outlet 309 of the nozzle of the jet pump 218. In the present embodiment, a section 310 extends from bit 301 to a joint 308 and is approximately five feet in length; and the remainder of the mining tool is comprised of a plurality of identical sections 315 joined together by bolts 311. In the present embodiment each section 315 is approximately 20 feet in length. A partial sectional view of a section 315 of the mining tool 113 is illustrated in FIG. 7 and will presently be described in detail. A cutting jet 114 emerges from a slot (not shown) in the tool section 315 after being emitted from the nozzle 251. The ultrasonic transducer 252 is attached to nozzle 251. The fluid source for the nozzle 251 is a supply tube 312 which is slidable along with the nozzle 251 in a channel (not shown) in each of the sections 315 of the mining tool 113. The supply tube to the cutting jet nozzle 251 is assembled in sections 313, which are connected together by bolts 314. Continuing upward on the mining tool is shown another sections 316 which is connected at a joint 317 to the power swivel 125. The power swivel 125 allows rotation of the joined sections of the mining tool 113 by a motor 318 acting through a gear system 319. All portions of the mining tool below the gear 319 rotate, whereas, gear 319 and those portions of mining tool 113 above gear 319 remain stationary. The power swivel 125 is lifted by a ring 327 joined to the power swivel 125 by a pin 326 and secured by a cotter pin 328. The nonrotating portion of the power swivel 125 provides three points of attachment for fluid supply lines, the uppermost and largest being that for a slurry removal line 324, at which point slurry raised by the jet pump 218 is removed from the mining tool 113. High pressure water used for operation of the jet pump enters the mining tool 113 through a jet pump supply inlet 323; and water for the agitation jet 254 enters through an agitation inlet 322.

Also illustrated in FIG. 3 is the cutting jet swivel 130, comprised of a seal 331, a rotary joint 332 and an inlet 333. An uppermost supply tube 329 to the cutting jet nozzle 251 is visible above the power swivel 125 with the electric cable 334 associated with the ultrasonic transducer 252. A seal 331 is provided between uppermost section 329 and the rotary joint 332. The rotary joint 332 is necessary since the nozzle 251 is rotated along with the middle section of mining tool 113; and a rotary joint is essential to prevent the supply tube to the nozzle 251 from being twisted. The inlet 333 is the high pressure supply inlet to the cutting jet. A ring 336 provides a point for attachment of a hoist (not shown) used to lift the swivel 130 with attached supply tubes 329, 312 and nozzle 251.

Figure 4:
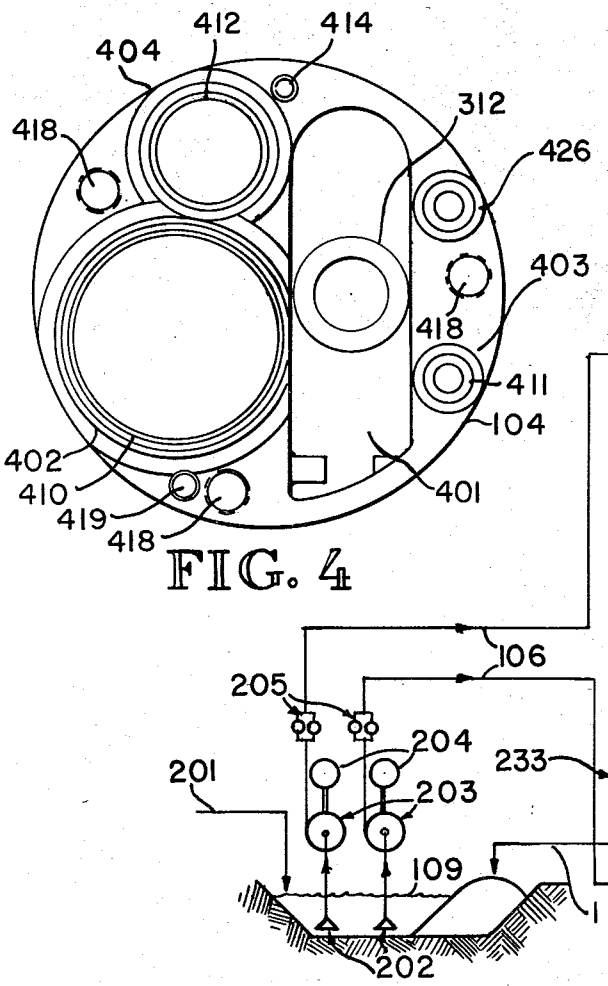
FIG. 4 is a cross-sectional view of the mining tool taken along line 4—4 of FIG. 3.

FIG. 4 is an end elevational view of a section 315 of the mining tool. Visible are the ends of the jet pump supply tube 414, and an agitation jet supply tube 403 and the end of an outlet passage 402 from the nozzle of the jet pump. Surrounding the ends of the supply tubes 402, 403, 404 are grooves 410, 411, 412, respectively, which accept O-rings (not shown) to provide seals between adjoining sections. The sections are held together by bolts (not shown) which pass through bolt holes 418 with the sections aligned for quick assembly by pins 419. A slot 401 is provided that is large enough to allow the passage of the end of jet nozzle 251.

FIG. 7 is a cross-sectional view of a section 315 of the mining tool taken along line 7—7 of FIG. 3. The tubes 312, 402, 403 and 404 are as in FIG. 4. The slot 401, which is constructed of welded metal sections, is shown in detail revealing a pair of guide bars 420, 421 which align with a corresponding pair of flats 405 on the cutting jet nozzle (not shown). The slot 401 has a rear surface 423 which provides a sliding surface for a pair of shoes 422 and 433 on the cutting jet nozzle assembly to absorb the reaction force of the jet. The slot 401 thus provides a path for guiding the up and down movements of the cutting jet, while allowing the cutting jet to cut at any point along the length of the section 315. A tube 426 is also provided for passage of electrical cables.

Figures 5, 6:
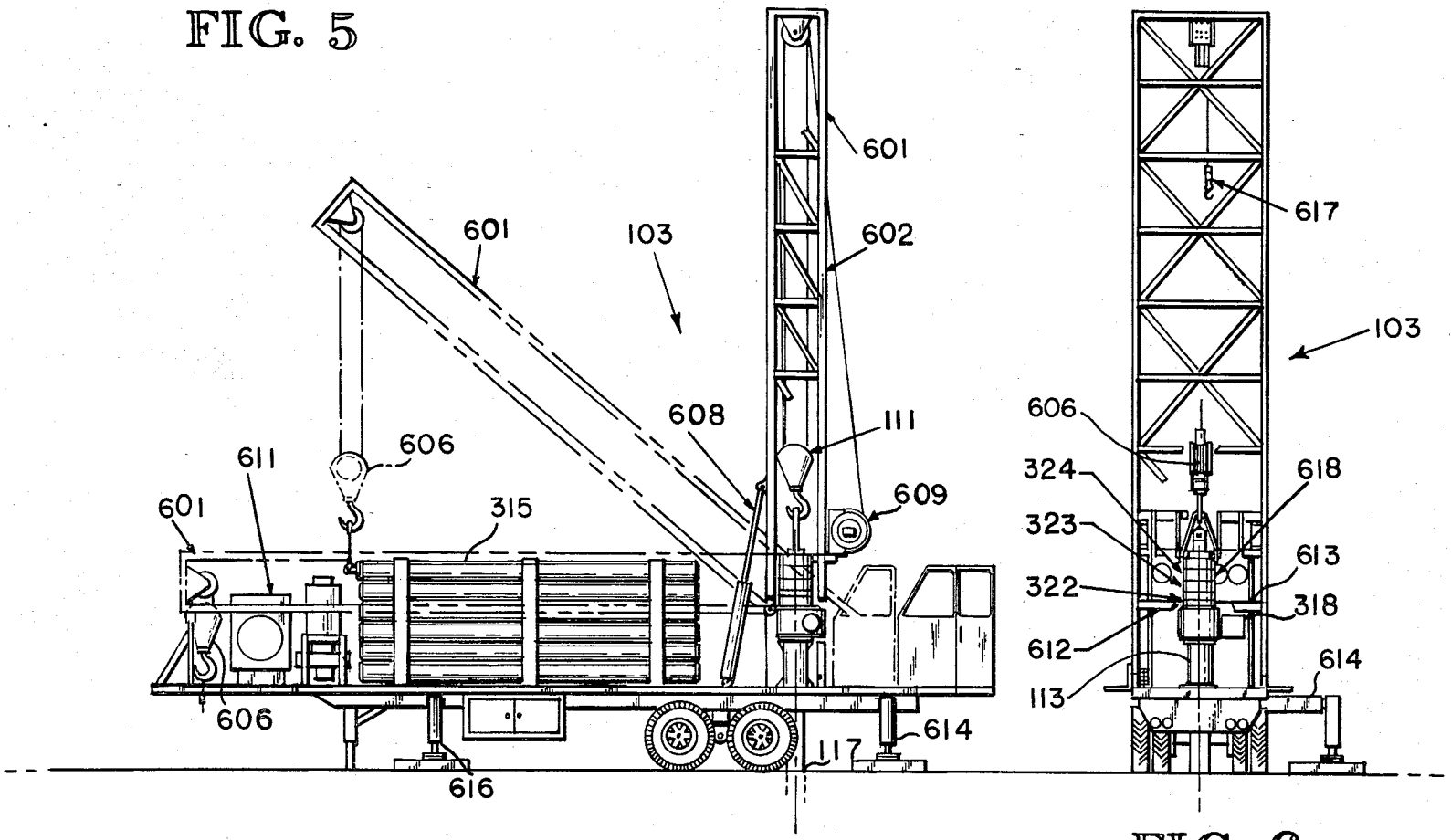
FIG. 5 is a side elevational view of the mining trailer.
FIG. 6 is an end elevational view of the mining trailer.

FIG. 5 is a side elevational view of the mining trailer 103 of the invention showing a derrick 601 which is pivotal between a mining position, a lifting position and a stowed position. A main hoist 111 which has a 50 ton capacity at 30 ft/min, is shown lifting a mining tool section 315 from storage. The carrying capacity of the mining trailer 103 is a total of thirty 20 ft. sections 315 of 13" diameter. The derrick 601 is lifted by two lifting cylinders 608, which have a capacity of 15 tons. The trailer 103 is a standard 8'×45' trailer suitable for highway operations to transport the derrick 601 in the stored position.

When mining is started, the mining tool 113 is first lowered into the predrilled borehole 117 by the derrick 601 and the hoist 606. Hoist 111 is powered by a motor 609, which may be a Germatic Model 4405 120 GPM, at 250 psi hydraulic motor, or equivalent, powered by a diesel hydraulic power generator 611. Once the first section of the mining tool 113 is lowered into the borehole 117, further mining sections 315 are bolted together and lowered into borehole 117 by hoist 606 until mining tool 113 is of sufficient length to function as described above.

FIG. 6 is an end elevation view of the trailer 103 of FIG. 5. Visible in this view are the mining tool inlets 322, 323 and the slurry removal line 324, which are connected as described above. When the mining tool 113 is rotated or oscillated through the power swivel 125 by the motor 318, anti-rotation arms 612 and 613 prevent rotation of the unswiveled portions of the mining tool 113. The trailer 103 is stabilized during mining operations by outriggers 614 and 616. A secondary hoist 617 moves the cutting jet independently of the mining tool 113 by lifting the cutting jet swivel 130 which lifts the nozzle 251 from which the cutting jet issues.

FIG. 8 is a side elevation view of the cutting jet assembly. The figure is broken at line 9—9 but is understood to be continuous. The cutting jet issues from the nozzle 251 during cutting operations. The nozzle 251 receives fluid from the supply tube 312 through an elbow 406, which is sealed to nozzle 251 by an O-ring (not shown) and connected by a pair of bolts 407. The shoe 422 is attached to the elbow 406 by means of a gusset 409 and a pair of bolts 413 and 414 to allow the cutting jet assembly to slide in the slot in the mining tool section 315. A plow 417 is provided to clear material that may enter the slot in the mining tool 113. A flange 427 extends from the upper portion of the supply tube 312, allowing attachment to other supply tubes and the source of high pressure fluid. A housing 425, positioned between elbow 406 and flange 427, stiffens the assembly and provides a housing for the ultrasonic sensor 252. The flange 427 is attachable to similar flanges (not shown) in the supply system by bolts passing through holes 429 and 430 with alignment pins 428 and 431 providing quick assembly.

FIG. 9 is a cross-sectional view of the FIG. 8 assembly illustrating the position of pins 428 and 431 and holes 429 and 430 in the flange 427. Cross hair vanes 432 are provided in the interior of the supply tube 312 to ensure non-turbulent flow of fluid therein with similar vanes being provided in the interior of the nozzle (not shown).

FIG. 10 is a cross-sectional view of the FIG. 8 assembly showing the attachment of the shoes 422 and 433 to the gusset 409 by the bolt 413. The shoes 422 and 433 provide the bearing surface which contacts the rear portion of the mining tool sections (not shown) and allows transfer of reactive forces generated by the cutting jet 114 to the mining tool 113.

FIG. 11 is a vertical cross-sectional view taken along the vertical centerline of the mining tool 113 in a plane bisecting the cutting nozzle 251 shown in the lower portion of the FIG. 8 assembly. It is apparent that the fluid stream must execute a 90° turn in the interior of the elbow 406 when passing from the supply tube 312 to the nozzle 251, which may introduce turbulence, which detracts from the quality of the cutting jet issuing from nozzle 251. Accordingly turning vanes 434 are provided in elbow 406 which, together with the cross hair vanes 435 in nozzle 251 and similar cross hair vanes 432 in the supply tube 312, ensure non-turbulent flow in the system. The profile of the nozzle 251 produces high-quality cutting jets by having an angled section 436 making an angle of about 15° with longitudinal axis of the nozzle 251 and a straight section 437 having a length approximately three times the diameter thereof.

Although the present invention has been described with reference to a particular embodiment thereof, it will be understood by those skilled in the art that modifications may be made without departing from the scope of the invention. Accordingly, all modifications and equivalents which are properly within the scope of the appended claims are included in the present invention.

What is claimed is:

1. A bole hole mining tool, comprising:

a slurry removal section;

a jet cutting section connected to said slurry removal sections means including an elongated tubular member, having a vertical slot therein and means glidably mounting said jet cutting means within said vertical slot for axial movement of said jet cutting means relative to said slurry removal section;

means for moving said jet cutting means independently of said slurry removal section in a vertical directions, whereby said jet cutting means may be selectively positioned relative to said slurry removal section.

2. A borehole mining tool, as in claim 1 further comprising:

means connected to said elongated tubular member for rotating said member and said jet cutting means within said elongated tubular member a full 360°.

3. A borehole mining tool as in claim 1, wherein said jet cutting means may be removed from said elongated tubular member while said elongated tubular member is in a borehole without removing said elongated tubular member.

4. A borehole mining tool as in claim 3, wherein a single jet is used as the cutting means.

5. A bore hole mining tool comprising:

a slurry removal section;

a jet cutting section connected said slurry removal section including a cutting jet supply line;

a nozzle connected to said cutting jet supply line including a converging nozzle section having vanes for preventing turbulence; and a straight cylindrical nozzle section in fluid communication with said converging nozzle section with the length of said straight cylindrical nozzle section being at least three times the width thereof;

means for moving said jet cutting means relative to said slurry removal section.

6. A borehole mining tool as in claim 1, wherein said jet cutting means further includes:

a cutting fluid supply line in said vertical slot for supplying fluid;

and, a nozzle connected to said fluid supply line; and means for reducing turbulence in the flow of fluid to said nozzle.

7. A borehole mining tool as in claim 6, wherein said turbulence reduction means includes flow straightening vanes in said nozzle.

8. A borehole mining tool as in claim 6, wherein said turbulence reduction means includes turning vanes in said fluid supply line.

* * * * *